United States Patent [19]

Morita

[11] Patent Number: 4,462,154

[45] Date of Patent: Jul. 31, 1984

[54] HOLDER FOR USE IN ASSEMBLING TOP END-STOPS TO SLIDE FASTENERS

[75] Inventor: Toyoo Morita, Uozu, Japan

[73] Assignee: Yoshida Kogyo K.K., Tokyo, Japan

[21] Appl. No.: 450,346

[22] Filed: Dec. 16, 1982

[30] Foreign Application Priority Data

Dec. 30, 1981 [JP] Japan ..... 56-194659

[51] Int. Cl.[3] ..... A41H 37/06; B21D 53/50

[52] U.S. Cl. ..... 29/767; 29/408; 29/766

[58] Field of Search ..... 29/408, 409, 410, 33.2, 29/766, 767

[56] References Cited

U.S. PATENT DOCUMENTS

| | | | |
|---|---|---|---|
| 3,504,418 | 4/1970 | Perlman | 29/207.5 |
| 4,074,413 | 2/1978 | Taccini | 29/767 |
| 4,217,685 | 8/1980 | Seki | 29/408 |
| 4,242,785 | 1/1981 | Shimai | 29/408 |
| 4,332,071 | 6/1982 | Takahashi | 29/767 |
| 4,368,570 | 1/1983 | Morita | 29/766 |

*Primary Examiner*—Howard N. Goldberg
*Assistant Examiner*—Steven Nichols
*Attorney, Agent, or Firm*—Hill, Van Santen, Steadman & Simpson

[57] ABSTRACT

A holder for use with a punch-type of top end-stop applying apparatus includes a fixed support member and a reciprocably movable guide member coactive therewith for laterally spacing the opposite inner edges of a pair of slide fastener stringers. The support member is recessed to receive therein a pair of rows of coupling elements mounted on the opposite stringer tape edges. The guide member has a pair of spaced projections receivable between the stringers, one projection having a width for laterally spacing confronting coupling elements, and the other having a greater width for laterally spacing confronting element-free stringer tape edges, the guide member having a clearance for the punch between the projections.

5 Claims, 5 Drawing Figures

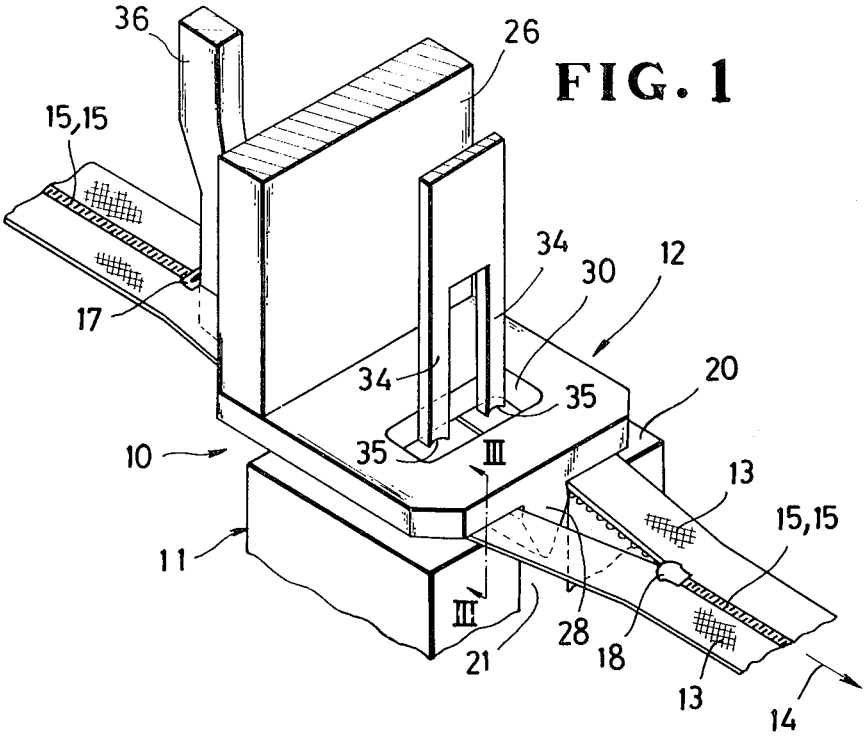
FIG. 1
FIG. 2
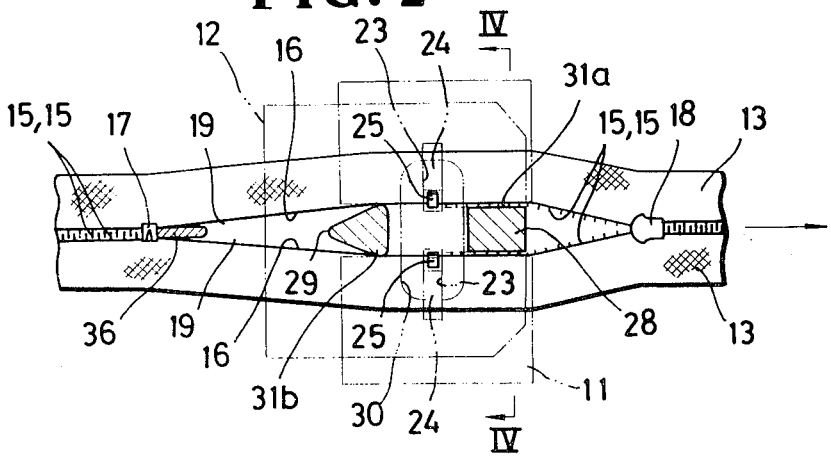

HOLDER FOR USE IN ASSEMBLING TOP END-STOPS TO SLIDE FASTENERS

BACKGROUND OF THE INVENTION

1. Field of the Invention

The present invention relates to apparatus for use in connection with assembling top stops to slide fastener stringers (proposed classification 29-32.2).

2. Prior Art

In a top end-stop applying machine shown in U.S. Pat. No. 3,504,418, issued on Apr. 7, 1970, a pair of upper and lower tongue-like thin spreaders works together in maintaining the opposite tape edges in proper spaced lateral alignment throughout the top end-stop application. Both spreaders, however, are disposed on a common side of a punch-and-die unit with respect to the direction of movement of the stringer tapes. With this arrangement, the opposed tape edges extend at slight angles with each other and rows of coupling elements mounted on such tape edges are likely to become out of register with the punch-and-die unit, with the result that a neat and accurate application of top end stops is difficult to achieve. Furthermore, the spreaders have no means for preventing a fluttering movement of the stringer tapes during assembly of the top end-stops, such fluttering movement resulting in faulty tape placement causing a misapplication of the top end-stops.

SUMMARY OF THE INVENTION

A holder comprises a fixed support member having a pair of recesses extending along the opposite edges of a horizontal groove for receiving therein a pair of rows of coupling elements mounted on the opposite edges of a pair of stringer tapes, and a reciprocable guide member having an aperture through which the punch of a top end-stop applying punch-and-die unit is movable, and a pair of projections disposed for engaging a pair of slide fastener stringers at opposite sides of the aperture. The guide member is movable toward the support member to such an extent that their confronting surfaces jointly define therebetween a space slightly larger than the thickness of the stringer tapes. The width of one projection is such that it engages and laterally spaces the confronting coupling elements of a separated slide fastener, and the width of the other projection is such that it engages and laterally spaces the confronting edges of an element-free portion of the stringer tapes thereof. By this arrangement the edges between the projections are held parallel to each other.

It is an object of the present invention to provide a holder for laterally spacing the opposite inner edges of a pair of slide fastener stringer tapes in properly spaced parallel alignment at a work station, in order to enable a punch-and-die unit to neatly and accurately apply a pair of top end-stops to the ends of the opposite rows of coupling elements mounted on the opposed tape edges.

It is a further object of the invention to enable the holder to guide the slide fastener movement to the work station while preventing flutter during top end-stop assembly.

Many other advantages, features and additional objects of the present invention will become manifest to those versed in the art upon making reference to the detailed description and the accompanying drawings in which a preferred embodiment incorporating the principles of the present invention is shown by way of illustrative example.

BRIEF DESCRIPTION OF THE DRAWINGS

FIG. 1 is a fragmentary schematic perspective view of a slide fastener holder according to the present invention, the view showing the holder and its related parts in position ready for a top end-stop application to a pair of slide fastener stringer tapes;

FIG. 2 is a schematic cross-sectional view taken on a plane extending parallel to the general plane of the stringer tapes of FIG. 1, with parts being shown by phantom lines for clarity;

DETAILED DESCRIPTION

Figure 3:
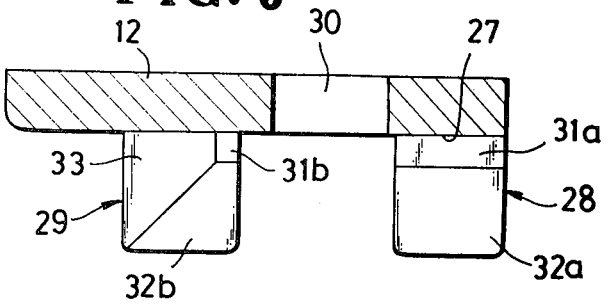
FIG. 3 is an enlarged longitudinal fragmentary cross-sectional view taken in a vertical plane indicated by line III—III of FIG. 1.

The principles of the present invention are particularly useful when embodied in a slide fastener holder such as shown in FIG. 1, generally indicated by the numeral 10.

The holder 10 comprises a lower fixed support member 11 and an upper guide member 12 reciprocably movable toward and away from the support member 11. A pair of continuous slide fastener stringer tapes 13, 13 is movable between the support and guide members 11, 12 in the direction of the arrow 14. As shown in FIG. 2, a series of pairs or rows of coupling elements 15, 15 is mounted on and along the opposite longitudinal edges 16, 16 of the stringer tapes 13, 13 at longitudinally spaced intervals, each coupling element 15 partially projecting transversely beyond the corresponding one of the longitudinal tape edges 16, 16. Each row of coupling elements 15, 15 is fastened together at their leading ends by a bottom end stop 17. The rows of coupling elements 15, 15 are also intermeshed by a slider 18 located intermediate their opposite ends. The portions of the rows of coupling elements 15, 15 between each slider 18 and the corresponding bottom end stop 17 are intermeshed, while the remaining portions (only one being illustrated) are disengaged, there being an element-free space 19, 19 between the trailing end of each pair of rows of coupling elements 15, 15 and the bottom end stop 17 on the following pair of rows of coupling elements 15, 15.

Figure 4:
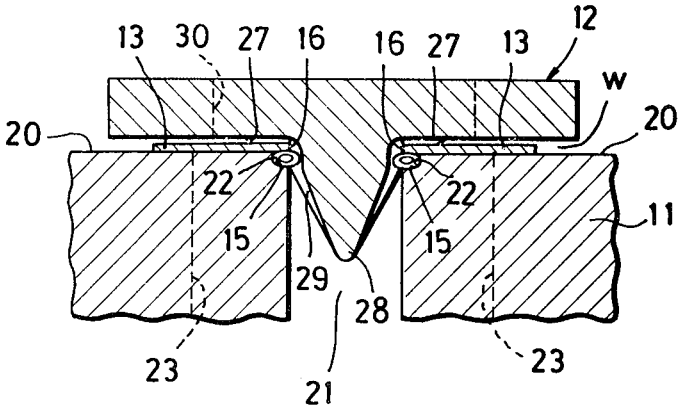
FIGS. 4 and 5 are enlarged transvere cross-sectional views taken along line IV—IV of FIG. 2, showing the stringer tapes in aligned and mis-aligned conditions, respectively.

As shown in FIGS. 1 and 4, the support member 11 has a top surface 20 over which the stringer tapes 13, 13 are movable, a groove 21 extending horizontally through the support member 11 and opening to the top surface 20. The groove 21 has a predetermined width corresponding to the distance between the opposite edges 16, 16 when the stringer tapes 13, 13 are spread apart for the application of a pair of top end stops (not shown). The support member 11 further has a pair of elongated recesses 22, 22 (FIG. 4) extending in the top surface 20 along the opposite edges of the horizontal groove 21 for receiving therein the respective rows of coupling elements 15, 15. A pair of slots 23, 23 extends vertically in the support member 11 and opens perpendicularly to the horizontal groove 21 in confronting relation to one another. As shown in FIG. 2, a pair of die blocks 24, 24 is received in the respective vertical slots 23, 23, each die block 24 having a horizontal groove 25 of arcuate cross-section registering with one of the horizontal recesses 22 (FIG. 4) for receiving therein the corresponding trailing coupling elements 15.

As shown in FIGS. 1 to 4, the guide member 12 includes an upstanding block 26 (FIG. 1) connectable for reciprocable movement to an actuator (not shown). Upon movement of the actuator, the guide member 12 moves downwardly toward the support member 11 to such an extent that its bottom surface 27 and the top surface 20 on the support member 11 jointly define therebetween a space or clearance W (FIG. 4) for substantially limiting any tape flutter, which space is slightly greater than the thickness of the stringer tapes 13, 13. The guide member 12 also has a pair of spaced tapered projections 28, 29 extending from the bottom surface 27 and insertible into the horizontal groove 21 in the support member 11. A rectangular aperture 30 extends in the guide member 12 between the projections 28, 29.

Each of the projections 28, 29 includes a base portion 31*a*, 31*b* having a uniform width, and a depending finger portion 32*a*, 32*b* contiguous to the base portion 31*a*, 31*b* and having a width gradually reduced in a downward direction, namely toward the distal end of the projection 28, 29. The width of the base portion 31*a* of one projection 28 (righthand in FIG. 3) is engageable with and laterally spaces the opposite rows of coupling elements 15, 15 as received in the recesses 22, 22 in the support member 11. On the other hand, the width of the base portion 31*b* of the other projection 29 (lefthand in FIG. 3) is engageable with and laterally spaces the element-free opposite tape edges 16, 16 when the opposite rows of coupling elements 15, 15 are received in the support member's recesses 22, 22. In other words, the maximum width of the projection 28 is smaller than the maximum width of the projection 29 by an amount which is twice the length that the portion of each coupling element 15 projects beyond the tape edges 16, 16. The projection 29 has an end wall 33 facing away from the projection 29 and tapering in a direction away from the same.

As shown in FIGS. 1 and 2, a pair of integral punches 34, 34 (FIG. 1) is disposed above the guide member 12 in registration with means for supplying non-clinched top end-stops or top end-stop material (not shown), and has a pair of downwardly facing arcuate grooves 35, 35 at their ends, complemental to and coactive with the die grooves 25, 25. The punches 34, 34 are reciprocably movable through the aperture 30 in the guide member 12 toward and away from the mating die blocks 24, 24 (FIG. 2) for clinching or curling the top end stops tightly around the trailing ends of the opposite rows of coupling elements 15, 15 by means of the coactive arcuate grooves 25, 35. A chain stopper 36 is disposed upstream of the holder 10 and is reciprocably movable for being inserted into the element-free space 19 (FIG. 2). The chain stopper 36 serves to stop the movement of the stringer tapes 13, 13 when it has been moved by the succeeding bottom end stop in the direction of the arrow 14 for a predetermined distance, so as to position the trailing-ends of the opposite rows of coupling elements 15, 15 into the grooves 25, 25 in the die blocks 24, 24.

In operation, the stringer tapes 13, 13 are fed longitudinally over the top surface 20 on the support member 11 in the direction of the arrow 14. Then, the chain stopper 36 is actuated to project into the element-free space 19. At the same time, the guide member 12 is actuated to descend toward the support member 11. The descending movement of the guide member 12 causes the projections 29, 28 to engage with the opposite spaced tape edges 16, 16 and rows of coupling elements 15, 15, at which time the taper of the end wall 32 and the taper of the finger portions 32*a*, 32*b* enable the projections 28, 29 to enter smoothly respectively between the element-free spaces 19 and the rows of coupling elements 15, 15. As the guide member 12 further descends, the stringer tapes 13, 13 slide laterally on the top surface 20 away from each other due to continual engagement of opposite tape edges 16, 16 and of the opposite rows of coupling elements 15, 15 with the tapered finger portions 32*a*, 32*b* of the projections 28, 29. The descending movement of the guide member 12 is stopped when the guide member 12 reaches the predetermined lowermost position shown in FIG. 4. In this position the stringer tapes 13, 13 are guided stably in position in the clearance W between the top and bottom surfaces 20, 27 against any significant fluttering movement, and the opposite rows of coupling elements 15, 15 are received in the recesses 22, 22. The chain stopper 36 is forced by the succeeding bottom end-stop 17 to move therewith in the direction of the arrow 14 until the top or trailing ends of the rows of coupling elements 15, 15 are positioned in the grooves 25, 25 in the die blocks 24, 24, whereupon the movement of the stringer tapes 13, 13 is stopped.

As shown in FIG. 2, the opposite tape edges 16, 16 are maintained in parallel spaced lateral alignment with each other by means of the respective base portions 31*a*, 31*b* of the projections 28, 29 which engage with the opposite rows of coupling elements 15, 15 and the opposite tape edges 16, 16, respectively. The punches 34, 34 are actuated to descend through the aperture 30 in the guide member 12 toward the die blocks 24, 24 for crimping the top end-stops neatly and accurately onto the trailing ends of the opposite rows of coupling elements 15, 15.

Figure 5:
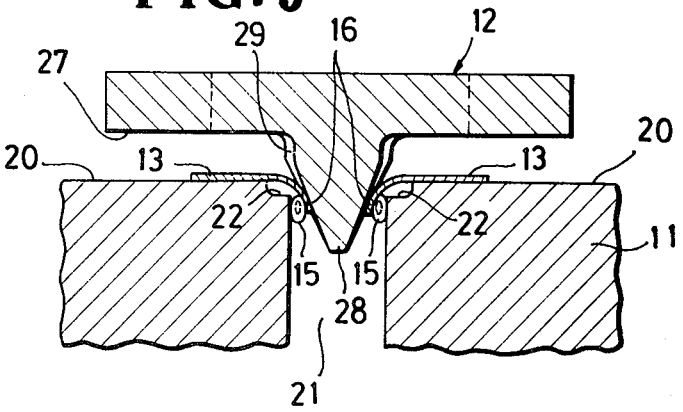

If the opposite rows of coupling elements 15, 15 were accidentally misaligned or displaced into the groove 21 as shown in FIG. 5, the misaligned coupling elements 15, 15 and the tape edges 16, 16 would hinder the descending movement of the projections 28, 29 and hence the guide member 12. Such obstruction to movement can be detected, for example, by an interlock switch (not shown) connected in circuit with a punch actuator (not shown) and normally actuatable by the guide member 12 as it reaches the unhindered lowermost position shown in FIG. 4.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A holder for laterally spacing the opposite inner edges of a pair of continuous slide fastener stringers in a punch and die assembly adapted to apply top end-stops to opposite rows of coupling elements on the opposite stringer tape edges, said holder comprising:

(a) a fixed support member having a first surface for supporting thereon the stinger tapes, a groove extending horizontally through said support member and opening to said first surface, and a pair of recesses extending in said first surface along the opposite edges of said groove for receiving therein the respective rows of coupling elements; and (b) a reciprocable guide member having a second surface confronting said first surface, said guide member being movable toward said support member to a position at which said first and second surfaces jointly define therebetween a space slightly larger than the thickness of the stringer tapes, a pair of spaced projections depending from said second surface and receivable in said groove, and an aperture extending between said projections for providing punch clearance.

2. A holder according to claim 1, said support member having a pair of vertical slots opening perpendicularly to said groove in confronting relation to one another for providing die clearance.

3. A holder according to claim 1, each said projection including a base portion having a uniform width, and a finger portion contiguous to said base portion and gradually reducing in width in a downward direction.

4. A holder according to claim 3, said base portion of one of said projections having a first width adapted to engage and space the opposite rows of coupling elements as they are received in said recesses in said support member, and said base portion of the other projection having a second greater width adapted to simultaneously engage and space the opposite tape edges.

5. A holder according to claim 4, said other projection having an end wall tapering away from and facing away from said one projection.

* * * * *